US007117622B2

(12) United States Patent
Freed et al.

(10) Patent No.: US 7,117,622 B2
(45) Date of Patent: Oct. 10, 2006

(54) TWO-PIECE SNAP-ON HANDGUN MAGAZINE ADAPTER

(76) Inventors: Robert M. Freed, 15016 59 th Pl. NE., Kenmore, WA (US) 98028; Gregory M. Somers, 5900 N. Starr Rd., Newman Lake, WA (US) 99025

( * ) Notice: Subject to any disclaimer, the term of this patent is extended or adjusted under 35 U.S.C. 154(b) by 145 days.

(21) Appl. No.: 10/798,964

(22) Filed: Mar. 13, 2004

(65) Prior Publication Data

US 2005/0011097 A1 Jan. 20, 2005

Related U.S. Application Data

(60) Provisional application No. 60/454,515, filed on Mar. 14, 2003.

(51) Int. Cl.
*F41A 9/61* (2006.01)

(52) U.S. Cl. ..... 42/7; 42/50; 42/90; 42/71.02

(58) Field of Classification Search ..... 42/7, 42/50, 49.02, 90, 49.01; 89/34; D22/108
See application file for complete search history.

(56) References Cited

U.S. PATENT DOCUMENTS 4,343,107 A * 8/1982 Kaltenegger ..... 42/7
4,592,160 A * 6/1986 Bross ..... 42/7
4,765,081 A * 8/1988 Dieringer ..... 42/50
4,862,619 A * 9/1989 Baldus et al. ..... 42/7
D344,780 S * 3/1994 Jenkins ..... D22/108
5,438,783 A * 8/1995 Sniezak et al. ..... 42/7
5,526,600 A * 6/1996 Chesnut et al. ..... 42/50
5,557,872 A * 9/1996 Langner ..... 42/117
5,584,136 A * 12/1996 Boland et al. ..... 42/7
5,642,582 A * 7/1997 Grams ..... 42/50
5,651,204 A * 7/1997 Hulsey et al. ..... 42/50
5,666,752 A * 9/1997 Grams ..... 42/49.02
6,557,287 B1 * 5/2003 Wollmann ..... 42/50
6,568,115 B1 * 5/2003 Beretta ..... 42/50
D487,791 S * 3/2004 Freed ..... D22/108

* cited by examiner

*Primary Examiner*—Michael J. Carone
*Assistant Examiner*—Stewart Knox
(74) *Attorney, Agent, or Firm*—NW Patent Group; James L Davison

(57) ABSTRACT

A two-piece snap-on magazine adapter for a handgun. This magazine adapter provides a relatively continuous surface between the handgun and locked extended length magazine to afford the handgun user with a comfortable grip among other benefits. In the preferred embodiment, the magazine adapter has two snap together pieces: a main body and an end cap. The main body has an interior pocket configuration contoured to capture the magazine floor plate. The main body of the device is then captured by an end cap that locks via a detent mechanism onto the main adapter body. The magazine adapter fits completely around the magazine such that when the magazine is locked into the handgun, the resulting grip provides a smooth, continuous and comfortable fit between the extended length magazine's floor plate and the butt of the handgun's grip. The magazine adapter of the present invention may be adapted to fit a variety of handgun models desirous of using extended length magazines without any modification of the magazine itself.

5 Claims, 6 Drawing Sheets

TWO-PIECE SNAP-ON HANDGUN MAGAZINE ADAPTER

CROSS-REFERANCE TO RELATED APPLICATIONS

This application is entitled to the benefit of Provisional Application 60/454,515 filed Mar. 14, 2003.

FIELD OF INVENTION

The present invention relates to a device for adapting an extended length handgun magazine to the grip of a handgun that was designed to accept a shorter length magazine.

BACKGROUND—DESCRIPTION OF RELATED ART

When extended length magazines, that are suited for carrying cartridges in full-size handguns, are used in compact automatic and semiautomatic handguns that were designed for smaller magazines that fit snugly into the grip of the handgun and carried fewer rounds, there was determined to be a need to be able to adapt the extended length magazine to fit the compact handguns designed for the shorter magazines. When unaltered extended length magazines are used in place of the shorter magazines a portion of that magazine protrudes below the bottom of the grip. This leaves a gap that can cause several problems. The protruding portion of the magazine is prone to catching on clothing or other objects, the gap between the grip and the bottom of the magazine leaves a portion of the magazine subject to dirt, moisture or other environmental contaminants and doesn't provided a continuous surface for the users to wrap their hands around to obtain a secure grip.

Existing art such as U.S. Pat. No. 4,592,160 (1986) and U.S. Pat. No. 4,495,720 (1985) both to Bross, show a pommel attaching to a magazine floor plate, where said floor plate is customized to accept and hold the attached pommel. The present invention does not require any modification or customization to the magazine foot plate. U.S. Pat. No. 4,862,619 (1989) to Baldus teaches an adapter that uses a magazine floor plate of a specific type (sliding type) to anchor the adapter to the magazine. Baldus therefore requires some disassembly and reassembly of the magazine in order to incorporate the adapter. The present invention does not. U.S. Pat. No. 5,438,783 (1995) to Sniezak and Dionne shows a customized magazine and butt plate combination that are securely assembled together. The present invention may be attached and detached from any magazine without customizing the magazine. This permits the present invention to be attached to existing magazines without any magazine modification or the use of "special" magazines. U.S. Pat. No. 6,557,287 (2003) to Wollmann teaches a magazine extension to a standard length magazine that extends the magazine capacity and increases the grip length of a handgun. The cavity of the extension holds the extra cartridges. The present invention does not introduce any increased capacity and does not modify or otherwise change the mechanism or operation of an existing magazine. U.S. Pat. No. 5,906,065 (1999) to Pearce shows a floor plate for a handgun magazine that is designed to seat and act as a base for the usual pressure transmission plate of the magazine spring. This again requires a modification of the handgun magazine so that the Pearce invention may be implemented.

BACKGROUND—OBJECTS AND ADVANTAGES

Automatic and semi-automatic handguns include a cartridge magazine that is removably housed in the handgun's grip. Certain handgun models allow the use of increased length magazines capable of holding a greater number of cartridges; this longer magazine replacing the standard magazine results in the closed end (bottom) of the magazine to protrude from the handgun's grip. Not only does the magazine's protrusion from the handgun provide for an awkward grip due to the disrupted surface contour, but also the portion of the magazine that extends from the handgun is subject to being caught on a holster or other object of clothing upon the drawing the handgun.

Accordingly, there exists a need for a device for use in conjunction with a handgun and increased size magazine that provides for both a comfortable grip, protects the magazine from the intrusion of dirt or moisture, and lessens the likelihood of the handgun being snagged when being brought into use.

One object of the present invention is to fulfill the need of a magazine adapter that does not interfere with or modify the standard operation of a standard designed cartridge magazine.

Another object of the present invention is to provide a magazine adapter that may be easily added and removed from an existing cartridge magazine with a minimum of tools.

Another object of the invention is to provide an extended contoured surface facilitating a firm and non-slip grip.

Another object of the invention is to provide a barrier to dirt, moisture and other environmental contaminants, thereby preventing their interference with the operation of either the handgun or cartridge magazine.

The present invention seeks to fulfill these needs and provides further related advantages.

SUMMARY

The present invention provides a magazine adapter for a handgun. The magazine adapter provides a relatively continuous surface between the handgun and locked extended length magazine to afford the handgun user with a comfortable grip among other benefits. In the preferred embodiment, the magazine adapter has two snap together pieces: a main body and an end cap. The main body has an interior pocket configuration contoured to capture the magazine floor plate. The main body of the device is then captured by an end cap that locks via a detent mechanism onto the main adapter body. The magazine adapter fits completely around the magazine such that when the magazine is locked into the handgun, the resulting grip provides a smooth, continuous and comfortable fit between the extended length magazine's floor plate and the butt of the handgun's grip. The magazine adapter of the present invention may be adapted to fit a variety of handgun models desirous of using extended length magazines.

BRIEF DESCRIPTION OF DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
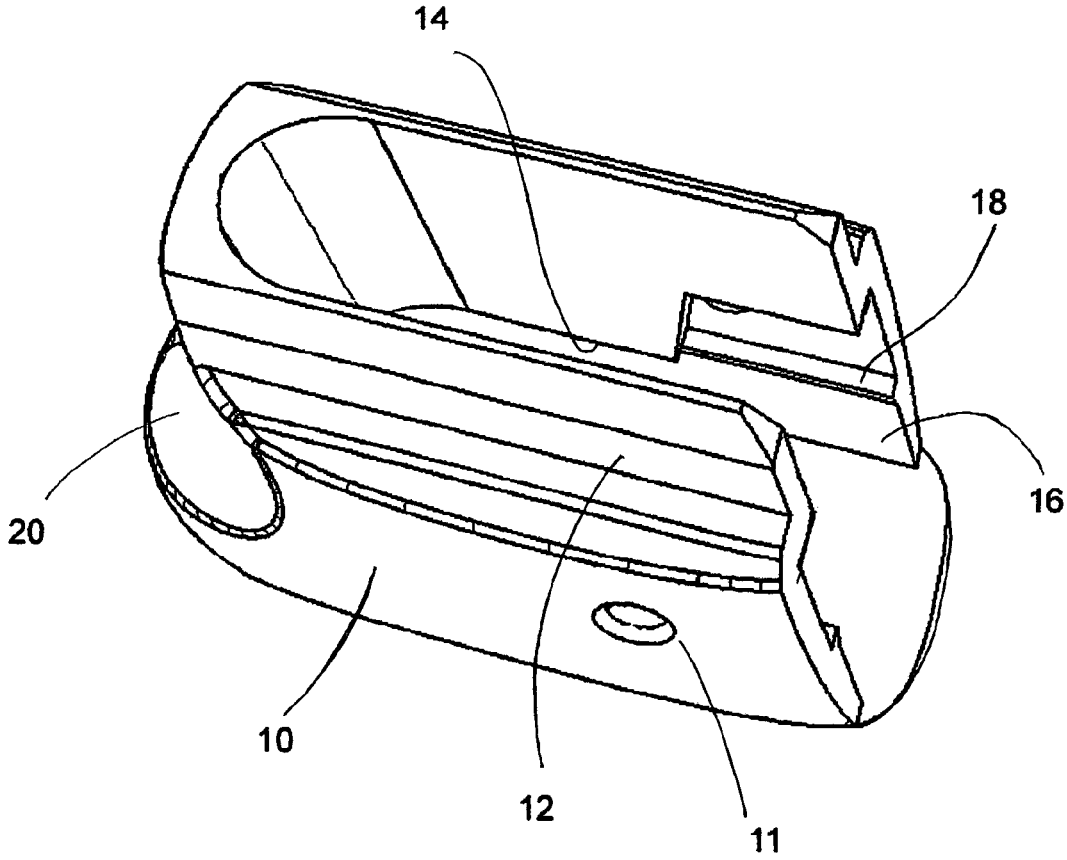
FIG. 1 shows the main body of the magazine adapter.
Figure 1A:
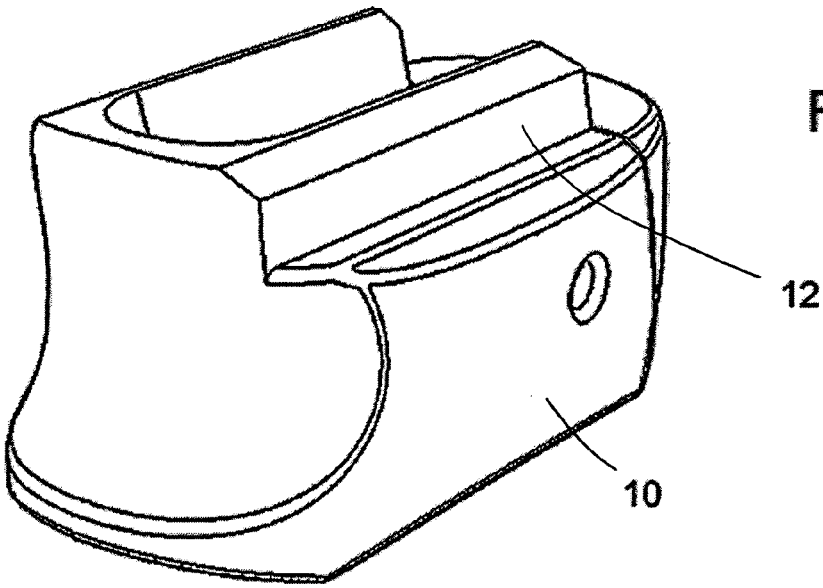
Figure 1B:
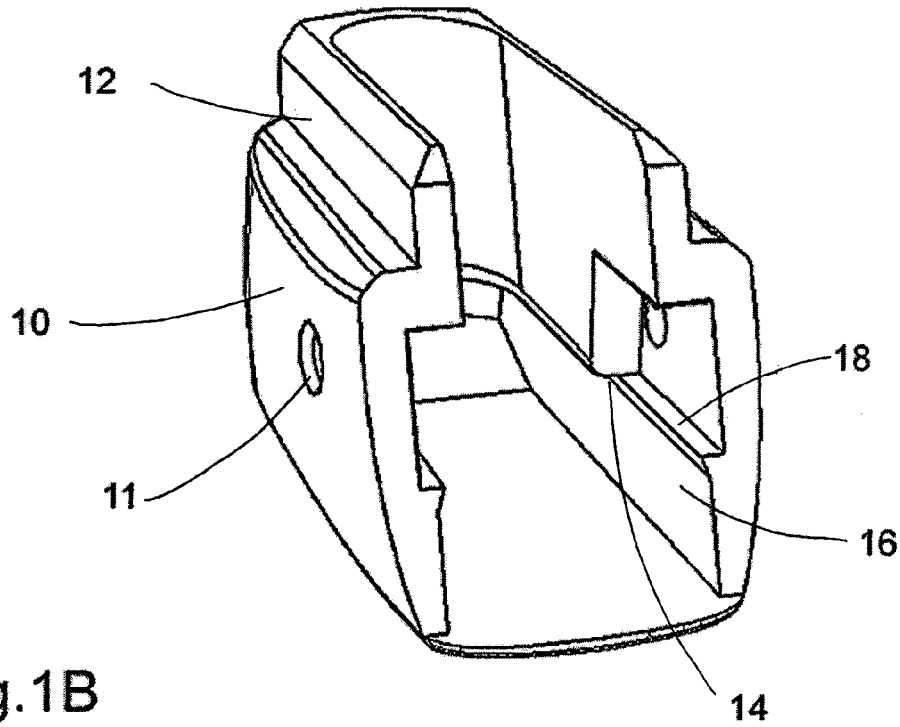
Figure 2:
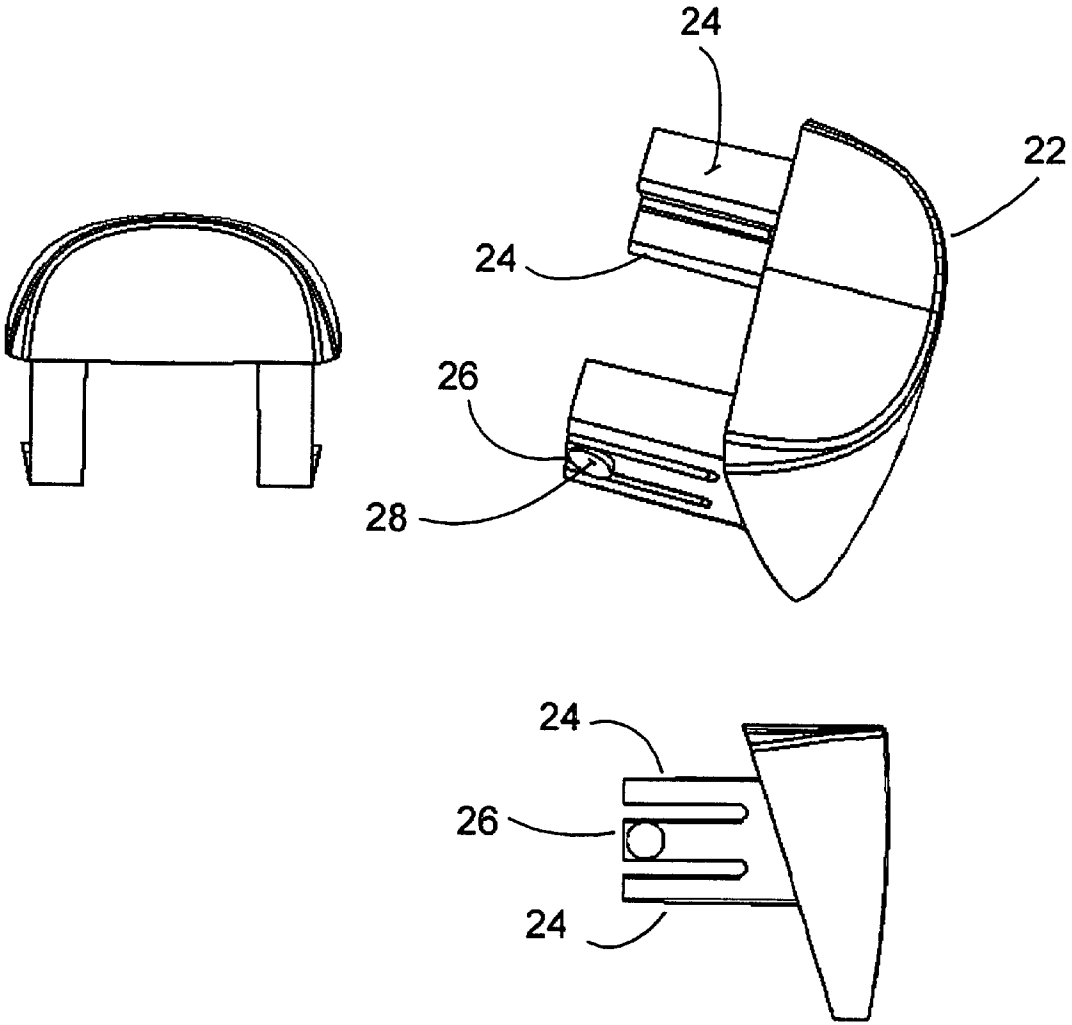
FIG. 2 shows the end cap of the magazine adapter.
Figure 3:
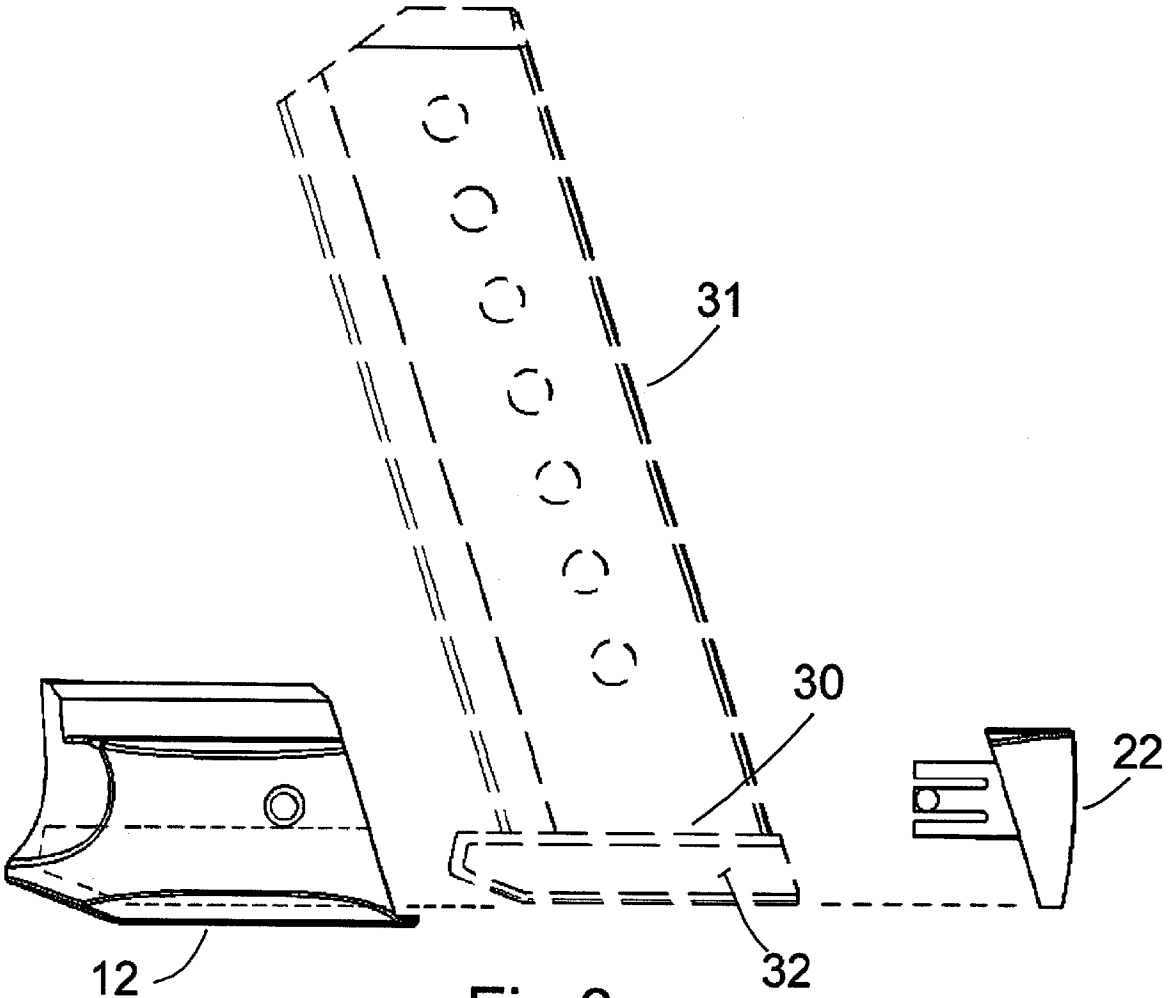
FIG. 3 shows the sequence of assembly.
Figure 4:
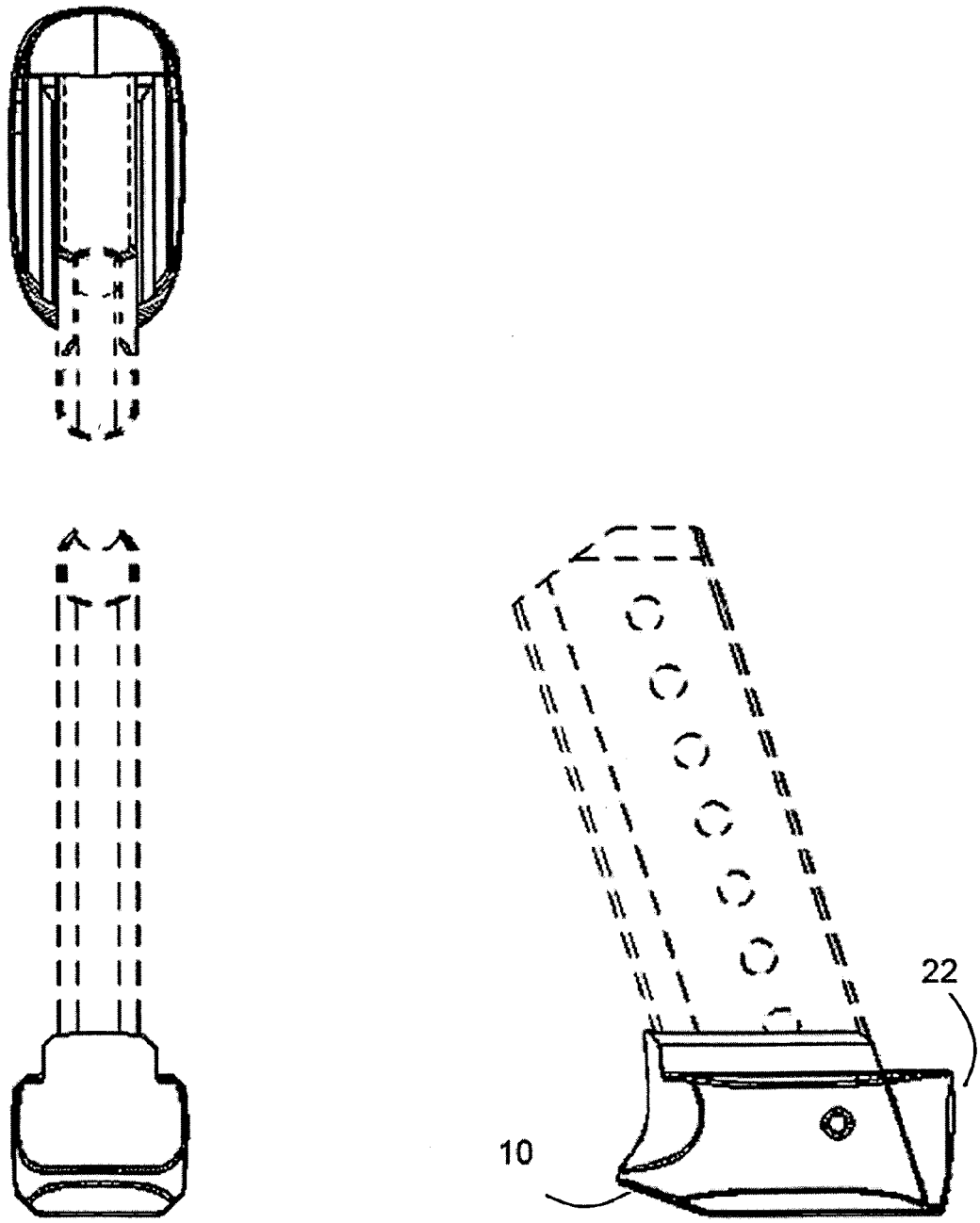
FIG. 4 shows the magazine adapter installed onto the magazine.
Figure 5:
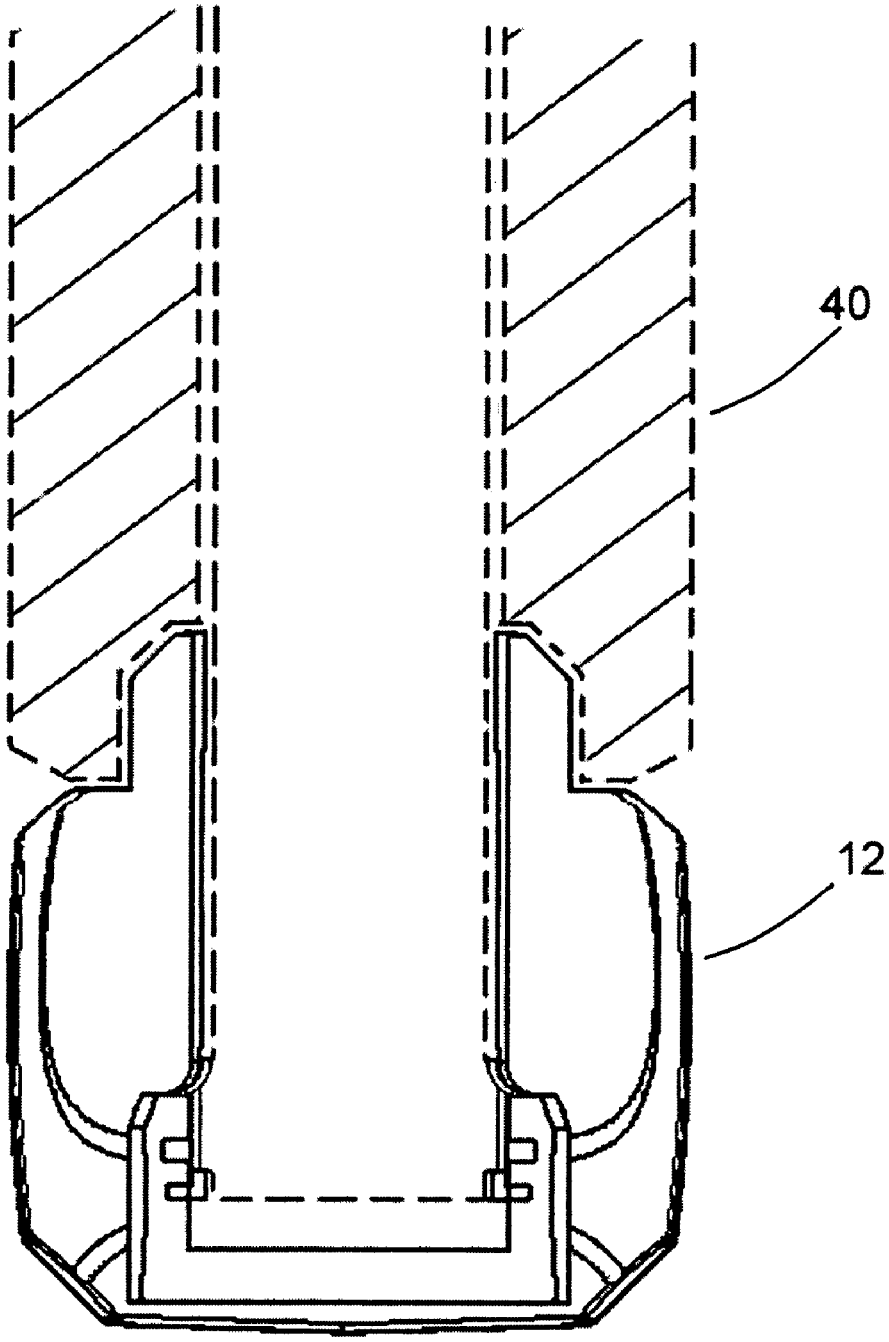
FIG. 5 shows the magazine adapter's upper flange mating with the bottom of the handgun's grip.

The present invention provides a magazine adapter allowing a handgun using an extended length magazine to have a continuous gripping surface. The magazine adapter is securely attached to an extended length magazine whereupon when said magazine is inserted and locked into the hollowed grip of an automatic or semiautomatic handgun there is no perceived gap between the bottom of the handgun's grip and the end of the extended length magazine. The magazine adapter's main body in FIG. 1 has a molded lower pocket 16 that receives the magazine floor plate 32 as shown in FIG. 3. The lower molded pocket is configured to have an internal contour that matches the external contour of the magazine floor plate. The magazine adapter has an internal shelf 14, the lower surface of said shelf acting as a bearing surface against the top of the magazine floor plate 30 as shown in FIG. 3, along with the bottom interior surface of the magazine adapter mating against the bottom of the floor plate thereby snugly capturing the floor plate between these two surfaces of the magazine adapter. The magazine adapter of the present invention substantially fills the void, about a magazine, defined by the gap when an extended length magazine is fully inserted into a handgun's grip. Referring to FIG. 4 the magazine adapter 10 is adapted to receive and fit about magazine 31 that is subsequently inserted into the handgun grip 40 as shown in FIG. 5. A representative embodiment of the magazine adapter of the invention is illustrated in FIG. 4. In this embodiment, the magazine adapter has a closed-collar configuration with the end cap 22 captured by the magazine adapter's main body 10 by means of a dimple 28 that is formed on the end cap rail 26. When the rails 24, 26 of the end cap 22 are inserted into the main body of the magazine adapter 10, guided by the recessed groves 18 configured into the main body, the dimple rails 26 are slightly flexed inward. When the rails are fully inserted into the magazine adapters main body the dimples align with the comparably shaped but slightly oversized apertures 11 and the flexure causes the dimples to be urged toward the aperture whereupon they are captured and secured by the aperture 11. The end cap and main body thereby form an effectively seamless surface for the user's grip. Referring to FIG. 5 the representative magazine adapter 10 having a closed-collar shaped body includes an upper flange 12 that is contoured such that the extender is receivable by a handgun's grip. By varying the main body of the extender's internal receiving pocket and upper-flanged surface, the extender can be adapted to fit any one of a variety of different model handguns.

As illustrated in FIGS. 1–5, the magazine adapter of the invention should have a height and thickness sufficient to fill the remaining gap that results when an extended length magazine has been fully inserted into a handgun's grip initially designed to accept a standard length magazine. As used herein, the term "height" refers to the gap dimension. The magazine adapter can have a variety of thicknesses. As used herein, the term "thickness" refers to the dimension generally from the exterior surface of the magazine outward to the handgun grip's outer surface (i.e., from the extender's interior surface to its outer surface). In the preferred embodiment, the extender has a thickness sufficient to provide a substantially continuous surface from the handgun's grip to the magazine base.

As noted above, the magazine adapter of the present invention can be formed to suit any one of a variety of handgun and magazine models. The magazine adapter's internal configuration can be varied such that a particular magazine can fit into and be snugly captured by the extender. The magazine adapter's upper surface can also be varied to conform to a particular handgun's grip end. Likewise, the magazine adapter's lower surface can be varied to receive a particular magazine. It will be appreciated that the magazine adapter of the invention can be formed to be adapted to a variety of handguns and magazines.

Ammunition cartridges used in handguns come in a variety of gunpowder loads usually measured in grains of powder and slug types and slug coatings such as hollow points, full metal jackets, and Teflon coatings, among others. Being able to differentiate which cartridges are loaded in which magazines would make it easier to select the correct cartridge for a particular circumstance. It is another object of the present invention to use the magazine adapter's shape or color to allow that distinguishing to occur. The magazine adapter may have embossed or debossed features such as bumps or dots to allow tactile differentiation. Colors, either molded in or added later to the magazine adapter, may be used to visually select the magazine with the appropriate cartridge for the situation. Or a combination of colors and physical features may be used.

The magazine adapter of the present invention can be formed as a molded plastic piece from a variety of materials. Suitable materials include elastomeric materials, such as plastics, for example, nylon, glass filled nylon and ABS, among others. For use in extremely cold climates a high impact glass filled nylon may be selected.

While the preferred embodiment of the invention has been illustrated and described, it will be appreciated that various changes can be made therein without departing from the spirit and scope of the invention.

We claim:

1. A two-piece device for adapting an extended length magazine for use in a handgun, said handgun having a hollow grip designed to accept a shorter length magazine, said two-piece device comprising:

a) a first piece having an interior cavity configured to receive that part of the extended length magazine protruding below the hollow grip when the extended length magazine is placed and locked into the grip;

b) the first piece also having at least two interior recessed grooves;

c) a second piece configured to conjoin with the first piece, said second piece having at least two opposing rails, said rails having protruding buttons, with the rails slidably engaged into the recessed grooves of the first piece, with the buttons captured by corresponding holes in the first piece when the second piece is fully engaged into the first piece; and d) the first and second pieces having an exterior conformation that, when the two pieces are conjoined, form a continuous surface.

2. The two-piece device of claim 1 further including a flange extending from the conjoined surface directed toward the grip and captured by the grip interior when the extended length magazine is inserted and locked into the grip.

3. The two-piece device of claim 1 further including a surface color, said surface color indicative of a type of cartridge loaded into the extended length magazine.

4. The two-piece device of claim 1 further including a surface texture, said surface texture indicative of a type of cartridge loaded into the extended length magazine.

5. The two-piece device of claim 1 further including a tactile surface symbol that may be perceived in low light conditions, said surface symbol indicative of the type of cartridge loaded into the extended length magazine.

* * * * *